United States Patent [19]

Fleck

[11] 4,403,882

[45] Sep. 13, 1983

[54] HANGER-BINDER

[76] Inventor: Michael P. Fleck, Grayrock Rd., Clinton, N.J. 08809

[21] Appl. No.: 284,325

[22] Filed: Jul. 17, 1981

[51] Int. Cl.[3] ..... A47B 63/00; B42F 15/00

[52] U.S. Cl. ..... 402/4; 281/15 B; 312/184; 402/8; 402/13

[58] Field of Search ..... 312/183, 184; 402/4, 402/8, 13, 68, 80 R; 281/15 A, 15 B

[56] References Cited

U.S. PATENT DOCUMENTS

| | | | |
|---|---|---|---|
| 1,644,541 | 10/1927 | Owen | 402/8 |
| 3,826,582 | 7/1974 | Podosek | 402/4 |
| 4,232,918 | 11/1980 | Leber | 312/184 |

FOREIGN PATENT DOCUMENTS

| | | | |
|---|---|---|---|
| 188962 | 11/1905 | Fed. Rep. of Germany | 312/184 |
| 2525522 | 12/1976 | Fed. Rep. of Germany | 312/184 |
| 2163768 | 5/1980 | Fed. Rep. of Germany | 281/15 A |
| 7539533 | 7/1977 | France | 281/15 B |

*Primary Examiner*—Paul A. Bell
*Attorney, Agent, or Firm*—Robert J. Ferb

[57] ABSTRACT

A novel hanger binder for binding and storing perforated edge paper in conventional suspension filing systems. The hanger binders which are used in pairs have two side members with hooks to engage conventional suspension filing apparatus. Perforated edge paper is bound between the side members on a binding post and thereby supported without continuous support along the length of the paper.

Two types of hanger binders are included. One made of wire with a rigid binding post. The other has a flexible binding post and greater variability of spacing to bind and store larger numbers of sheets.

6 Claims, 9 Drawing Figures

Fig. 2
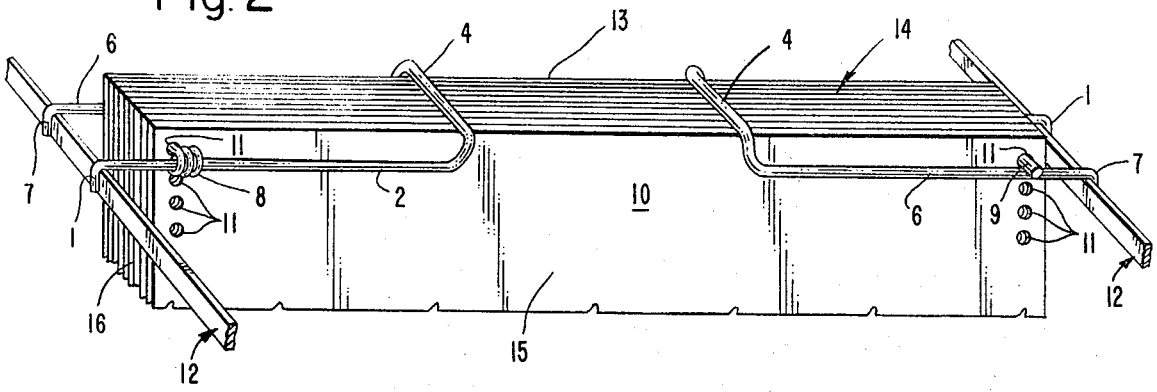
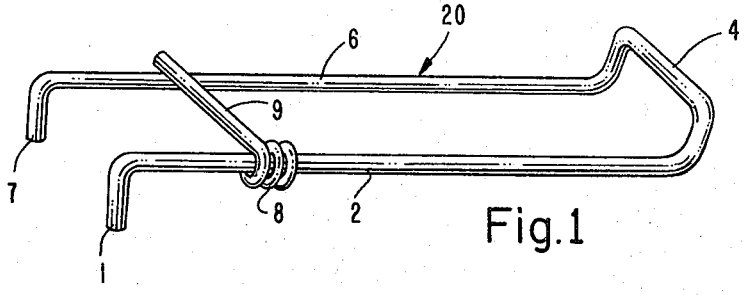
Fig.1
Fig. 3A
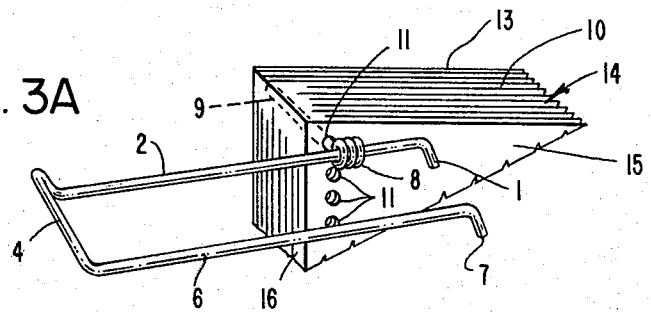
Fig.3B
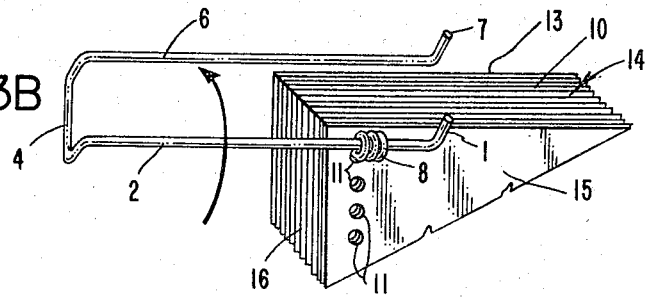
Fig.3C
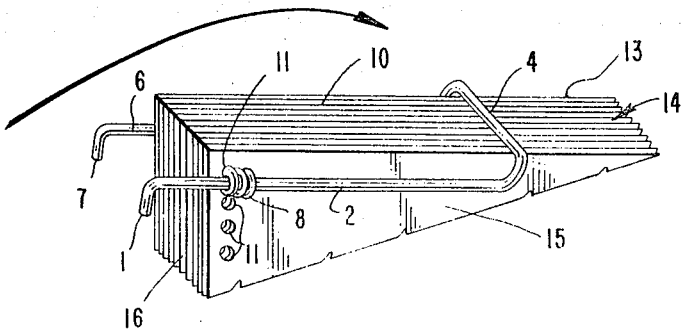

Fig.5
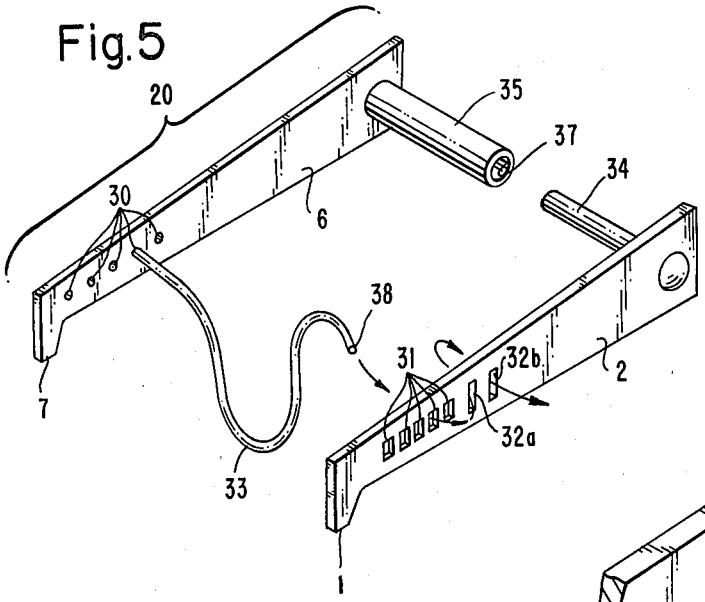
Fig.4C
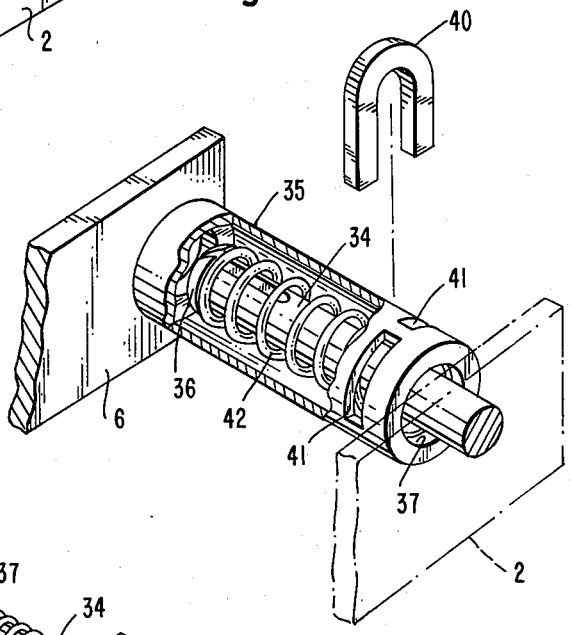
Fig.4A
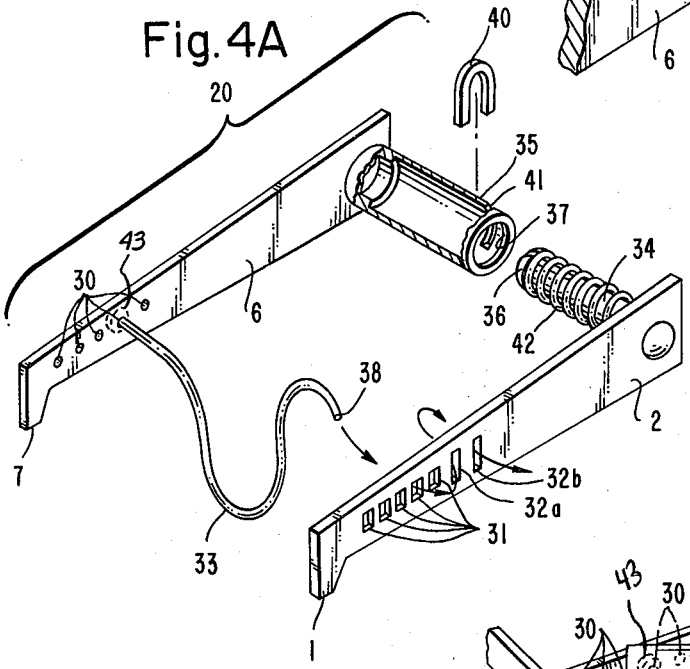
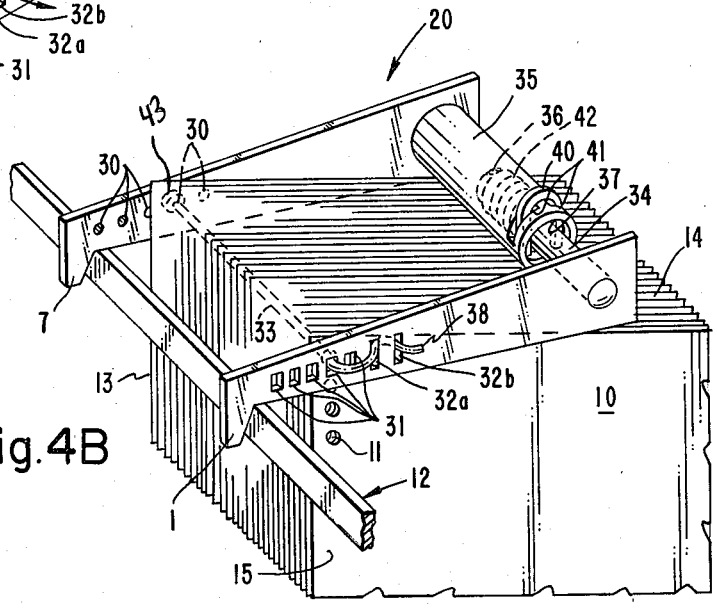
Fig.4B

HANGER-BINDER

BACKGROUND OF THE INVENTION

This invention relates to binding and suspending loose leaf documents, especially computer type printouts with sprocket feed perforations on their edges.

The growth of computer use over the last decade has created a veritable flood of computer printouts in almost innumberable forms. The physical dimension of the printed sheets as well as the number of pages in any given output vary with the type of equipment in use and the users needs. In addition, many of these reports are valid for short periods of time, representing updates to continuing files that will be reprinted in a day, a week, a month, or otherwise. When the updated report is generated, prior versions are archived or discarded. Also many such reports are referred to frequently for information while current.

In addition to the extensive use of computers by larger organizations, the advent of relatively inexpensive computer installation is bringing the computer printout to many small businesses.

There are numerous means presently available to bind these computer printouts and numerous methods of storing printouts. However, the means presently available generally require special storage racks, relatively complex hangers, or separate binders. The characteristics of these devices often render them inconvenient to use and require a substantial investment for racks, binders and hangers.

Therefore, the primary object of this invention is to provide a simple innovative means for binding and simultaneously providing suspended filing capability for documents printed on loose leaf perforated edge paper.

Another object is to provide an improved device for horizontal suspended filing of bound computer tab documents.

Another object is to simplify the method of application and removal of the binder/hanger device when compared to the alternatives currently available.

Another object is to provide a device that can accommodate the various widths of paper in use and the suspension filing apparatus in use with each width.

Another object is to provide a device that is adjustable to a range of report thicknesses.

Another object is to provide a device that is small enough to be stored conveniently while awaiting use.

Another object is to provide a device that is inexpensive and convenient enough to permit its everyday use for even short-term filing requirements.

A further object is to provide an improved means for binding perforated sheets that does not block a viewing of the printed matter on the sheets.

A further object is to provide a means of suspending perforated sheets that can use existing parallel suspension systems.

A further object is to provide a means of suspension for perforated sheets which can be readily retracted or removed to facilitate use or photocopying without interference by the binding device.

A further objective is to provide an improved binder to facilitate the removal or addition of sheets to the bundle.

These and other objects which would be apparent to one skilled in the area are accomplished by the invention as set forth and described herein.

SUMMARY OF INVENTION

The within invention incorporates a "U" shaped hanger with a movable binder. This assembly can be constructed of wire, plastic, or other appropriate material fashioned from one or more pieces to form the basic "U" shape with a binder cross-member perpendicular to the arms of the "U" and attached to one arm in a manner that permits it to swivel in an arc and to rest on the opposite arm of the device. The crossmember is inserted through a perforation in the sheets to be bound, the binder hanger is then flipped over the sheets to be bound, and rotated, with the crossmember as its axis, so that the closed end of the "U" rests on the back of the sheets and the open ends of the "U" protrude from the outer edge of the sheets to engage the suspended filing apparatus. By placing one binder/hanger on each end sheets are bound and can be filed vertically suspended at each end in a rack or standard file drawer equipped for suspended filing.

Prior solutions to the binding of loose leaf reports, presume the need for continuous support across the entire back of the document being bound when in fact secure binding at the corners, and support of both sides for suspended filing obviate the need for full length support in most applications.

Other features and many of the advantages of the invention are set forth in or rendered obvious by the following detailed specification and the accompanying drawings wherein:

FIG. 1 is a perspective view of the invention showing the basic characteristices of the device.

FIG. 2 is a perspective view showing a computer printout bound at each end and suspended on a file rack.

FIGS. 3A, B, and C show the method of applying the invention to a computer report demonstrating the ease of application and removal.

FIG. 4A shows an alternative embodiment of the invention designed to accommodate variable widths, with a flexible binder and a compression spring to hold the side members together.

FIG. 4B shows the embodiment of FIG. 4A applied to one end of a typical computer printout suspended in a file rack.

FIG. 4C shows the components of the compression spring and retainer.

FIG. 5 shows an alternative embodiment of the invention without the compression spring.

DESCRIPTION OF INVENTION

In FIG. 1 there is shown the preferred form of the invention wherein a metal wire or other suitable material is shaped to form a hook 1 rigidly attached to side member 2. Said side member 2 is also rigidly attached to cross member 4 so that cross member 4 is approximately perpendicular to side member 2. Said cross member 4 is also rigidly attached to side member 6 so that cross member 4 is approximately perpendicular to side member 6 and side member 6 is approximately parallel to side member 2. Said side member 6 is also rigidly attached to hook 7. Said hook 7 being approximately parallel to hook 1. A binder cross member 9 is rotatably and translationally attached by coil 8, or any other suitable means of so attaching binder cross member 9, to side member 2. Binder cross member 9 is of sufficient length to span the distance between side member 2 and side member 6. When binder cross member 9 is rotated about side member 2 it will come to rest on side member 6. These elements comprise the hanger assembly 20.

FIG. 2 illustrates a computer printout 10 with side perforations 11 bound and suspended between conventional suspension rails 12 using a hanger assembly 20 at each end of computer printout 10 for binding and support.

The application of the preferred embodiment of hanger assembly 20 to a computer printout 10 is illustrated in FIGS. 3A, B & C.

In FIG. 3A binder cross member 9 is shown fully inserted into side perforation 11 of front side 15 of computer printout 10.

After insertion of binder cross member 9, the other components of hanger assembly 20 are rotated around the longitudinal axis of side member 2 in the direction of the arrow shown in FIG. 3B over the top of computer printout 10 until side member 6 comes to rest on the binder cross member 9 where binder cross member 9 protrudes from side perforation 11 of back side 13 of computer printout 10. After the above rotation side member 6 is resting on top of binder cross member 9.

Next the other components of hanger assembly 20 are rotated around the longitudinal axis of binder cross member 9 in the direction of the arrow shown in FIG. 3C until cross member 4 contacts top side 14 of computer printout 10.

At this point portions of side members 2 and 6 protrude past end 16 of computer printout 10 and hooks 1 and 7 are in a position to engage suspension rail 12 for suspension of computer printout 10 for storage.

The extent of the protrusion of side members 2 and 6 past end 16 of computer printout 10 is selected to match the distance separating the suspension rails 12 so that computer printout 10 is bound and supported as illustrated in FIG. 2. If adjustment of this protrusion is necessary hanger assembly 20 can be readily moved laterally by sliding side rail 2 through coil 8 to the desired position.

An alternative embodiment of the invention with a variable spacing between side members 2 and 6 is depicted in FIG. 4A.

In this embodiment side member 2 is preferably rectangular in cross section with the long sides of the rectangle in the vertical plane with an integral hook 1 pointing down in the vertical plane rigidly attached to one end of side member 2. At the other end of side member 2 a cross pin 34 with a round or other suitable cross section is rigidly attached to side member 2 so that the long axis of cross pin 34 is perpendicular to the vertical plane of side member 2. Side member 2 has a horizontal row of binder slots 31 which penetrate side member 2. These binder slots 31 are located near the end of side member 2 where hook 1 is located.

A pair of securing slots 32*a* and 32*b* are located adjacent to the binder slots 31 on side member 2. These securing slots 32*a* & *b* which horizontally penetrate side member 2 are located on side member 2 between binder slots 31 and cross pin 34.

A second side member 6 similar in rectangular cross section and orientation to that of side member 2 with integral hook 7 in the vertical plane is used in cooperation with side member 2. Side member 6 has a horizontal row of binder holes 30 which penetrate side member 6. These binder holes 30 are located near the end of side member 6 where hook 7 is located. The number of binder holes 30 in side member 6 is equal to the number of binder slots 31 in side member 2. In addition, the row of binder holes 30 is located in such a way that each binder hole 30 is located at the same horizontal distance from hook 7 of side member 6 as corresponding binder slot 31 is located from the hook 1 of side member 2.

Cross tube 35 is rigidly attached to the end of side member 6 opposite to the end where hook 7 is located. The longitudinal axis of cross tube 35 is perpendicular to the vertical plane of side member 6. Cross tube 35 has a longitudinal aperture 37 of a size suitable to accept insertion of compression spring 42 and cross pin 34.

The longitudinal axis of cross pin 34 and cross tube 35 are located the same distance from the hook ends of side member 2 and 6 to which they are attached.

Compression spring 42 is placed on cross pin 34 by forcing it over the enlarged end 36 of cross pin 34 so that after compression spring 42 is forced over enlarged end 36 of cross pin 34 it is retained by enlarged end 36 and is prevented from slipping off cross pin 34 when compressed in use.

Cross tube 35 has a pair of spring retainer slots 41 which are of sufficient size to accept spring retainer 40 located near the open end of cross tube 35.

After cross pin 34 fitted with compression spring 42 is fully inserted into appurture 37 in cross tube 35 spring retainer 40 is inserted into spring retainer slots 41 so that compression spring 42 is retained between spring retainer 40 and enlarged end 36 of cross pin 34. Thus, when side members 2 and 6 are spread apart to fit over computer printout 10 spring 42 is compressed and tends to pull side members 2 and 6 towards each other causing side members 2 and 6 to press against sides 13 and 15 of computer printout 10. This pressure against sides 13 and 15 of computer printout 10 augments the binding of computer printout 10 accomplished with flexible binder 33.

This embodiment would normally be preassembled as a unit with side members 2 and 6 attached as described above.

When this preassembled unit is to be used to actually bind computer printout 10 flexible binder 33 is used to bind one end of computer printout 10 between side members 2 and 6. Flexible binder 33 is sized to pass through binder hole 30 until enlarged end 43 reaches binder hole 30. When enlarged end 43 which is larger than binder hole 30 reaches binder hole 30 flexible binder 33 is prevented from being pulled through binder hole 30.

The actual binding of computer printout 10 is accomplished by passing free end 38 of flexible binder 33 through side perforation 11 of computer printout 10 after flexible binder 33 has been passed through binder hole 30 in side member 6. To facilitate the above step side member 2 can be rotated out of alignment with side member 6. After flexible binder 33 is inserted as described above and pulled through side perforation 11 until side member 6 is pressing against back side 13 of computer printout 10 side member 2 is pulled away from side member 6 compressing spring 42. Next free end 38 of flexible binder 33 is inserted through corresponding binder slot 31 and side member 2 is rotated to realign with side member 6 and released so that side member 2 presses against front side 15 of computer printout 10.

The binding process is completed by pulling flexible binder 33 sufficiently tight to draw side members 2 and 6 against sides 13 and 15 of computer printout 10, passing free end 38 through securing slots 32*a* & *b* and again drawing flexible binder 33 tight to remove slack in flexible binder 33 between side members 2 and 6, as well as removing slack between binder slot 31 and securing slots 32*a* & *b*. Next the hanger assembly 20 is rotated around the axis of flexible binder 33 until cross tube 35 rests on top 14 of computer printout 10.

In this configuration side members 2 and 6 protrude past end 16 of computer printout 10 with hooks 1 and 7 extended so that suspension rail 12 can be engaged if desired to support computer printout 10.

FIG. 4B illustrates computer printout 10 bound between side members 2 and 6 with cross pin 34 engaged within cross tube 35 and hooks 1 and 7 engaging suspension rail 12.

A second binder is also used to bind the opposite end of computer printout 10 so that it can be suspended in a conventional fashion between a pair of suspension rails 12 by hooks 1 and 7 protruding beyond each end of computer printout 10 in the same fashion as illustrated in FIG. 2.

FIG. 5 illustrates an embodiment of the invention similar to that shown in FIGS. 4*a* & *b* but without compression spring 42 and the ancillary means for retaining same.

In this embodiment aperture 37 of cross tube 35 is slightly larger than cross pin 34 so that cross pin 34 can be readily inserted and removed from cross tube 35 permitting side members 2 and 6 to be separated.

To bind computer printout 10 free end 38 of flexible binder 33 is passed through side perforation 11 of computer printout 10 and then passed through binder slot 31 in side member 2.

Next, cross pin 34 on side member 2 is engaged with cross tube 35 on side member 6. To bind computer printout 10 free end 38 of flexible binder 33 is passed through side perforation 11 of computer printout 10 and then passed through binder slots 31 in side member 2. The flexible binder 33 is pulled so that computer printout 10 is compressed between side members 2 and 6. When the desired compression is achieved, free end 38 of flexible binder 33 is passed through securing slot 32*a* which is closest to the binder slots 31 inside member 2 and is pulled tight.

Next the free end 38 of the flexible binder 33 is passed through securing slot 32*b* and pulled tight.

From the above description of the structures comprising this invention it is obvious that they offer many distinct differences and improvements over prior art. For example, there is disclosed a very inexpensive combination hanger binder which can be readily opened to facilitate the removal or addition to material in the binder. The invention eliminates the need for separate binders and adjustable hangers and permits ready use of existing parallel rail suspension filing systems.

It is also obvious that the hanger binder as illustrated in FIG. 1 can be provided with a means to removably secure the free end of binder cross member 9 to side member 6 as an alternative embodiment of this invention. This securing means in an alternative embodiment includes the formation of a loop as an integral part of side rail 6 into which binder cross member 9 is inserted to hold it in place on side rail 6 after binding is completed.

It is also obvious that securing slots 32*a* & *b* are illustrative of means to secure flexible binder 33 to side member 2. For example, tabs, hooks or other similar structures are equally suitable for securing flexible binder 33 to side member 2.

It is obvious from the foregoing descriptions of the structure and operation that this invention can be applied to binding and suspending any type of perforated sheet without particular regard to the location or size of the perforations or to the relative location of the perforations and the suspension rails or other similar type of support system.

In the foregoing description, certain terms have been used for brevity, clarity and understanding, but no unnecessary limitations are to be implied therefrom beyond the requirements of prior art, because such words are used for descriptive purposes herein and are intended to be broadly construed.

Moreover, the embodiments of the improved construction illustrated and described herein are by way of example and the scope of the invention is not limited to the exact details of construction. It is, therefore, understood that, within the scope of the appended claims, the invention may be practiced otherwise than as specifically described herein.

I claim:

1. A binder hanger for binding and hanging sheet materials comprising:

(a) Two side members each of which has a hook at one end to engage a suspension means;

(b) a binder member rotatably and slidably attached to one of the side members of sufficient length to span the distance between the side members for binding the sheets between the side members; and (c) a cross member which joins the side members at their ends opposite from where the hooks are located.

2. A binder hanger as recited in claim 2 further comprising; means for removably securing the free end of the binder member to the side member to which the binder member is not rotatably and slidably attached to retain the binder member in place on the side rail after the sheets are bound.

3. A binder hanger for binding and hanging sheet materials comprising:

(a) A side member having a hook at one end to engage suspension means;

(b) A flexible binder secured to the side member;

(c) A second side member having a hook at one end to engage suspension means and at least one opening to accept the flexible binder so that the sheets are bound between the first and second side members;

(d) means to secure the flexible binder on the second side member;

(e) an annular cross member attached to the first side member at the end opposite from the hook; and (f) a cross member attached to the second side member at the end opposite from the hook shaped to engage the annular cross member for interconnection of the first and second side members.

4. A binder hanger as recited in claim 3, further comprising:

means for exerting tension between the first and second side members so that the side members press against the sheets bound between them.

5. A binder hanger as recited in claim 4, wherein the means for exerting tension between the side members is a spring.

6. A binder hanger as recited in claim 4 wherein the means for exerting tension between the side members is a coil spring located inside the annular cross member and retained therein so that the spring is compressed when the side members are spread apart.

* * * * *